US008230527B2

(12) United States Patent
Jeong et al.

(10) Patent No.: US 8,230,527 B2
(45) Date of Patent: Jul. 31, 2012

(54) LIGHTWEIGHT HELMET SHELL AND METHOD FOR MANUFACTURING THE SAME

(75) Inventors: Sang-Ok Jeong, Busan (KR); Wan-Ouk Kim, Seoul (KR); Young-Kyong Lee, Gyeongsangnam-do (KR)

(73) Assignees: Nanotech Ceramics Co., Ltd, Busan (KR); Soyo Enterprise Inc., Gyeongsangnam-do (KR)

( * ) Notice: Subject to any disclaimer, the term of this patent is extended or adjusted under 35 U.S.C. 154(b) by 310 days.

(21) Appl. No.: 12/579,979

(22) Filed: Oct. 15, 2009

(65) Prior Publication Data

US 2010/0088807 A1 Apr. 15, 2010

(30) Foreign Application Priority Data

Oct. 15, 2008 (KR) ..... 10-2008-0101065

(51) Int. Cl.
*A42B 3/10* (2006.01)
*A42B 3/06* (2006.01)
*A63B 71/10* (2006.01)

(52) U.S. Cl. ..... 2/425; 2/455; 2/410; 2/411; 2/412

(58) Field of Classification Search ..... 2/455, 410, 2/5, 6.1, 6.6, 6.8, 411, 412, 425, 171, 260, 2/260.1
See application file for complete search history.

(56) References Cited

U.S. PATENT DOCUMENTS 6,007,898 A * 12/1999 Kim et al. ..... 428/175
6,051,175 A * 4/2000 Kurihara et al. ..... 264/210.8
6,154,889 A * 12/2000 Moore et al. ..... 2/418
6,458,462 B1 * 10/2002 Kang et al. ..... 428/447
6,893,704 B1 5/2005 Van der Loo
7,008,979 B2 * 3/2006 Schottman et al. ..... 523/334
7,520,559 B2 * 4/2009 Vo et al. ..... 296/187.01
7,931,963 B2 * 4/2011 Maurer et al. ..... 428/314.8
2002/0010958 A1 * 1/2002 Schiebl et al. ..... 2/413
2002/0023291 A1 * 2/2002 Mendoza ..... 2/412
2002/0028261 A1 * 3/2002 Alessio ..... 425/112
2002/0066135 A1 * 6/2002 Tao et al. ..... 2/411
2002/0120978 A1 * 9/2002 Moore, III ..... 2/412
2003/0005511 A1 * 1/2003 Tao et al. ..... 2/411
2003/0049431 A1 * 3/2003 Hong et al. ..... 428/297.4
2003/0070200 A1 * 4/2003 Crye et al. ..... 2/6.6
2003/0200597 A1 * 10/2003 Dennis et al. ..... 2/410
2003/0203991 A1 * 10/2003 Schottman et al. ..... 523/334
2003/0221245 A1 * 12/2003 Lee et al. ..... 2/412
2004/0025229 A1 * 2/2004 Takahashi et al. ..... 2/412
2004/0034903 A1 * 2/2004 Blair ..... 2/411
2004/0040071 A1 * 3/2004 Dennis et al. ..... 2/412
2004/0040073 A1 * 3/2004 Morrow et al. ..... 2/424
2004/0064873 A1 * 4/2004 Muskovitz ..... 2/410
2004/0117896 A1 * 6/2004 Madey et al. ..... 2/411
2005/0015855 A1 * 1/2005 Skiba ..... 2/412
2005/0125881 A1 * 6/2005 Cheese ..... 2/410
2005/0198725 A1 * 9/2005 Mollo ..... 2/422
2005/0246824 A1 * 11/2005 Berger et al. ..... 2/412
2005/0261464 A1 * 11/2005 Schorr ..... 528/272
2005/0273911 A1 * 12/2005 Skiba et al. ..... 2/412
2005/0278834 A1 * 12/2005 Lee ..... 2/424
2006/0026742 A1 * 2/2006 Lang-Ree et al. ..... 2/412
2006/0043625 A1 * 3/2006 Medynski ..... 264/46.4
2006/0062715 A1 * 3/2006 Endo et al. ..... 423/447.2
2006/0078730 A1 * 4/2006 Tsukada et al. ..... 428/364
2006/0112477 A1 * 6/2006 Schneider ..... 2/412
2006/0162053 A1 * 7/2006 Lee ..... 2/411
2006/0195973 A1 * 9/2006 Ikeda ..... 2/410
2006/0216516 A1 * 9/2006 Handa et al. ..... 428/408
2006/0216517 A1 * 9/2006 Handa et al. ..... 428/408
2006/0277664 A1 * 12/2006 Akhtar et al. ..... 2/410
2006/0286382 A1 * 12/2006 Anzures et al. ..... 428/411.1
2007/0000031 A1 * 1/2007 Makris et al. ..... 2/411
2007/0011797 A1 * 1/2007 Ikeda ..... 2/424
2007/0158976 A1 * 7/2007 Vo et al. ..... 296/187.03
2007/0220662 A1 * 9/2007 Pierce ..... 2/410
2008/0172774 A1 * 7/2008 Ytterborn et al. ..... 2/412
2008/0229488 A1 * 9/2008 Kim ..... 2/412
2008/0289085 A1 * 11/2008 Bryant et al. ..... 2/421
2008/0299379 A1 * 12/2008 Maurer et al. ..... 428/314.4
2009/0044319 A1 * 2/2009 Lamson et al. ..... 2/459
2009/0062410 A1 * 3/2009 Maurer et al. ..... 521/79
2009/0124746 A1 * 5/2009 Handa et al. ..... 524/496
2009/0255037 A1 * 10/2009 Sandusky et al. ..... 2/455
2009/0260133 A1 * 10/2009 Del Rosario ..... 2/412
2010/0031426 A1 * 2/2010 Lapham ..... 2/411
2011/0229693 A1 * 9/2011 Maurer et al. ..... 428/159

FOREIGN PATENT DOCUMENTS

EP 0545182 6/1993
EP 1627719 2/2006
WO WO 2005102090 A1 * 11/2005
WO WO 2005122811 A1 * 12/2005
WO WO 2007/107359 9/2007
WO WO 2009/121902 10/2009

OTHER PUBLICATIONS

European Search Report issued in connection with corresponding European Patent Application No. 09172482 dated Aug. 16, 2010.
Office Action issued in connection with corresponding European Patent Application No. 09172482, dated Oct. 19, 2011.

* cited by examiner

*Primary Examiner* — Bobby Muromoto, Jr.
(74) *Attorney, Agent, or Firm* — Davidson, Davidson & Kappel, LLC

(57) ABSTRACT

A lightweight helmet shell includes an inner shell formed from a porous expanded plastic layer, and an outer shell, in which the outer shell is formed from a compressed fiber sheet having an apparent density of 0.15 to 0.7 g/cc and an impact absorbability of less than 300 G. The lightweight helmet shell has excellent breathability, is lightweight, and has improved impact absorbability.

15 Claims, No Drawings

LIGHTWEIGHT HELMET SHELL AND METHOD FOR MANUFACTURING THE SAME

This application claims priority from Republic of Korea patent application number 10-2008-0101065, filed on Oct. 15, 2008, the disclosure of which is hereby incorporated by reference in its entirety.

BACKGROUND OF THE INVENTION

1. Field of the Invention

The present invention relates to a lightweight helmet shell and a method for manufacturing the same. More particularly, the present invention relates to a lightweight helmet shell including an outer shell formed from a breathable compressed fiber sheet shell, which has excellent breathability, is lightweight, and has improved impact absorbability, and a method for manufacturing the same.

2. Description of the Related Art

Helmets worn to prevent injuries during outdoor leisure activities such as motorcycling, motor racing, inline skating and horse riding, are essentially required to absorb impact efficiently as well as to undergo minimal damage due to the impact, when the helmets happen to collide with the ground or any other objects.

In general, a helmet has, in its outer part, a helmet shell that is constituted of a helmet outer shell, which is produced to maintain the basic shape of the helmet and to have appropriate impact absorbability so as to absorb any impact exerted to the helmet and to prevent the impact from being transferred to the helmet wearer, and a helmet inner shell which lies beneath the outer shell and mitigates the impact exerted to the outer shell. The inner part of the helmet, which is also the inner part of the helmet shell, is lined with a liner or the like that gives a good feeling of wear when the wearer's head is in contact with the helmet.

Among these, in order to satisfy the requirements as described above, the helmet shell is required to have appropriate impact absorbability to the extent of being capable of maintaining the original external shape without undergoing deformation under impact. On the other hand, the helmet shell also needs to have toughness, since there is a risk of breakage at the time of collision if the rigidity of the helmet shell is excessively high. In addition to these, the helmet shell also needs to satisfy the requirement of having a small specific gravity, in order to make the feeling of wear pleasant.

Most of the helmet shells produced so far have been produced with fiber-reinforced plastics so as to satisfy the requirements as described above. Fiber-reinforced plastics are products obtained by incorporating fibers such as glass fiber, carbon fiber and aramid fiber, into thermosetting resins such as unsaturated polyesters and epoxy resins. These materials can be easily processed and can be produced into relatively thin sheets while still maintaining high strength and impact absorbability. Thus, fiber-reinforced plastics are materials that satisfy the above-described requirements to a certain extent.

However, since the fiber-reinforced plastics basically make use of thermosetting resins, as a matter of fact, they have insufficient toughness as compared with thermoplastic resins, and because of the insufficient toughness, helmet shells often undergo breakage when a large impact is exerted thereon. Prevention of such breakage needs to increase the thickness of the helmet shell, which leads to an increase in the production cost, as well as a problem of worsening the feeling of wear due to an increase in the weight of the helmet. In an attempt to solve such problems, the helmet outer shell was once produced using a thermoplastic resin. These fiber-reinforced plastics are constituted such that a resin matrix is provided as a base, and various organic and inorganic fibers, non-woven fabrics, knitted fabrics and the like are completely embedded in the resin matrix for the purpose of complementing the properties of resin. According to the recent trends in technology, such a resin matrix is used as a base and is formed to have a minimal thickness, and a lightweight material such as a fiber, a knitted fabric or an expanded material is formed on any one side or on both sides of the resin matrix.

According to Korean Patent Application No. 10-2004-0004746, it is reported that the weight of a conventional multilayer-structured helmet shell is reduced by 40% by replacing the outermost layer of the helmet shell with an ultrahigh molecular weight porous polyethylene. However, since a fiber-reinforced plastic layer should be essentially included in the multilayer structure, the overall rate of decrease in the weight of the multilayer structure is only less than 20%, and thus the helmet shell as a whole does not undergo sufficient weight reduction.

Korean Patent Application No. 10-2003-0054927 proposes a helmet shell formed from a hybrid complex material, which is formed by laminating a fiber-reinforced plastic layer and a highly elastic fiber-reinforced thin film complex material on the outer surface of a helmet inner shell produced by molding an expanded plastic material. However, this helmet shell also includes a fiber-reinforced plastic layer, and thus still has a problem of the weight reduction being insufficient.

Korean Patent Application No. 10-1993-0017354, Korean Patent Application No. 10-2000-0018132, U.S. Pat. No. 3,958,276, Japanese Patent Application No. 7-72907, Japanese Patent Application No. 7-189447, and Japanese Patent Application No. 2002-351348 suggest using a fiber network structure or a flexible fiber structure. However, these fiber structures are also involved in the formation of fiber-reinforced plastic (FRP) layers, and therefore, the technical limitation in the related art as described above has not yet been overcome.

U.S. Pat. No. 7,062,795 suggests using layers reinforced with a high strength network structure provided on the inner side and the outer side of a fiber-reinforced plastic layer, and there is still a problem that weight reduction is not achieved sufficiently.

As such, the technologies of the related art essentially involve the introduction of a fiber-reinforced plastic layer as a factor basically constituting the outermost layer of a helmet shell, and adopt the form in which such a fiber-reinforced plastic layer, and a material selected from porous or highly elastic materials having relatively low specific gravities, fibers, woven fabrics, knitted fabrics, non-woven fabrics, expanded materials, fiber-reinforced thin film materials and the like, are introduced and laminated in combination.

A helmet shell produced by a method such as described above has its weight reduced to a certain extent, but still has a problem that the weight reduction is not sufficient.

SUMMARY OF THE INVENTION

Accordingly, it is an object of the present invention to provide a lightweight helmet shell including an outer shell formed from a compressed fiber sheet shell, which has excellent breathability, is lightweight, and has improved impact absorbability, and a method for manufacturing the same.

According to an aspect of the present invention, there is provided a lightweight helmet shell including an inner shell and an outer shell, in which the outer shell includes a compressed fiber sheet having an apparent density of 0.15 to 0.7 g/cc and an impact absorbability of 50 G or more and less than 300 G.

The inner shell may include a porous expanded plastic layer.

The compressed fiber sheet may be a product obtained by subjecting a fiber sheet formed from a material including any one selected from the group consisting of polyethylene, polypropylene, polyester, viscose rayon, nylon, cotton, hemp, wool and combinations thereof, to a hot pressing treatment at a compression ratio of 1.2 times to 10 times.

The fiber sheet may be any one selected from the group consisting of a non-woven fabric, a woven fabric and a knitted fabric.

The hot pressing treatment may be conducted at a temperature of 50° C. to 200° C. and at a pressure of 10 to 3,000 atm, for 10 seconds to 30 minutes.

The compressed fiber sheet may contain a high melting point fiber which constitutes a fiber structural layer of the compressed fiber sheet and has a melting point of 120 to 350° C., and a low melting point which binds the high melting point fiber strands and has a melting point of 50 to 200° C.

The compressed fiber sheet may have an air permeability of 10 to 2,000 $cm^3/min/cm^2$.

The outer shell may have a thickness of 0.1 mm to 6 mm.

The lightweight helmet shell may further have a thermosetting resin or thermoplastic resin film layer having a thickness of 0.01 mm to 0.8 mm, on the outer side of the outer shell.

The lightweight helmet shell may further include a coating film layer having a thickness of 0.01 mm to 0.8 mm, formed by melting a thermosetting resin or a thermoplastic resin, on the outer side of the outer shell.

The lightweight helmet shell may further include a coating film layer formed by pretreating the outer side of the outer shell with a primer and then coating a paint to a thickness of 0.01 mm to 0.8 mm.

According to another aspect of the present invention, there is provided a method for manufacturing a lightweight helmet shell, the method comprising producing a fiber sheet; pressing the fiber sheet in a forming mold at a pressure of 10 to 3,000 atm; and heating the fiber sheet at 50° C. to 200° C. for 10 seconds to 30 minutes to produce a compressed fiber sheet.

The compressed fiber sheet may be a product obtained by subjecting the fiber sheet to a hot pressing treatment at a compression ratio of 1.2 times to 10 times.

The fiber sheet may be formed from a material including any one selected from the group consisting of polyethylene, polypropylene, polyester, viscose rayon, nylon, cotton, hemp, wool and combinations thereof.

The fiber sheet may be any one selected from the group consisting of a non-woven fabric, a woven fabric and a knitted fabric.

The fiber sheet may contain a high melting point fiber which constitutes a fiber structural layer of the fiber sheet and has a melting point of 120 to 350° C., and a low melting point which binds the high melting point fiber strands and has a melting point of 50 to 200° C.

The lightweight helmet shell according to the present invention has excellent breathability, is lightweight, and has improved impact absorbability.

DETAILED DESCRIPTION OF THE INVENTION

Hereinafter, the present invention will be described in more detail.

The present invention provides a lightweight helmet shell including an inner shell formed from a porous expanded plastic layer, and an outer shell, in which the outer shell is formed from a compressed fiber sheet having an apparent density of 0.15 to 0.7 g/cc and an impact absorbability of less than 300 G.

The inner shell is formed from a porous expanded plastic layer, and the material of the plastic layer may include a commercially available thermoplastic resin or a commercially available thermosetting resin. Specific examples of the material include polystyrene, polyethylene, polypropylene, polyethylene terephthalate, polycarbonate, acrylonitrile-butadiene-styrene (ABS) resin, polyvinyl chloride (PVC), ethylene-vinyl acetate (EVA) resin, nylon, epoxy resin, phenolic resin, polyurethane, unsaturated polyester and the like, but are not limited to these. Preferably, a resin having excellent impact resistance and molding resistance is selected among the commercially available thermoplastic resins or commercially available thermosetting resins. An article obtained by molding into the shape of the head using such an expanded plastic, is used to constitute the inner shell of the helmet shell of the present invention. The apparent density of the porous expanded plastic layer is preferably 0.005 to 0.2 g/cc.

The outer shell is formed from a compressed fiber sheet, which is in the form of a fiber sheet containing one or more materials selected from the group consisting of polyethylene, polypropylene, polyester, viscose rayon, nylon, cotton, hemp and wool. The fiber sheet may be, for example, a non-woven fabric, a woven fabric, a knitted fabric or the like, and is preferably a non-woven fabric. A non-woven fabric, woven fabric, knitted fabric or the like produced from a thermosetting resin may also be used, and in this case, a product produced by adding a thermoplastic resin having a melting point lower than that of the thermosetting resin to bind such thermosetting resin fiber strands, can also be used.

Since the outer shell of the helmet shell according to the present invention can completely exclude fiber-reinforced plastics, the outer shell has an advantage that the weight of the helmet can be reduced, and can solve various problems occurring when helmets are produced using fiber-reinforced plastics as described previously.

To explain the fiber sheet that serves as a raw material of the compressed fiber sheet in more detail, for example, in the case of a non-woven fabric, a fiber structural layer may be formed by spinning a raw material (mainly PE, PP or PET) and inducing self-adhesion of the fibers under the spinning heat, or a fiber structural layer may be produced by mixing the fiber obtained by spinning the raw material and the fiber of polypropylene or the like having a melting point lower than that of the spun fiber, and melting the fiber mixture under heat, pressure or the like to bind the fiber structure. The fiber sheet can also be produced using various other known methods for producing non-woven fabrics. The products obtained by the above-described two methods are all suitable as the raw material for producing the compressed fiber sheet outer shell according to the present invention. More preferably, a non-woven fabric, woven fabric or knitted fabric produced by mixing a spun fiber and a fiber such as polypropylene having a melting point lower than that of the spun fiber, and melting the mixture under heat, pressure or the like to bind the fiber structure, is suitable as the raw material for producing the compressed fiber sheet outer shell according to the present invention.

Particularly, a non-woven fabric thus processed is low in density and excellent in breathability, and thus is suitable for the compressed fiber sheet of the helmet outer shell of the present invention. The representative nature of non-woven fabrics leads to the formation of a highly dense structure and allows filtering of even very fine particles, so that the non-woven fabrics can function as a filter for gases, liquids and the like. Since such function of filtration is accompanied by a significantly large gas or liquid permeability, passage of air or the like is very free, and the fabric exhibits high breathability. High breathability implies that the non-woven fabric is a porous structure having many empty spaces within the fiber structural layer, and this plays a role in lower the apparent density of the fiber structural layer.

According to an embodiment of the present invention, the compressed fiber sheet has an air permeability of 10 to 2,000 $cm^3/min/cm^2$.

However, although such a fiber structural layer acquires a certain degree of impact absorbability when formed into an appropriate form, there is a problem that the fiber structural layer may be torn off or sag when an impact above a certain limit is exerted, causing the impact absorbability to drop.

It is a well known fact that a helmet shell requires both rigidity and toughness, for its main purpose of suppressing the transmission of an external impact to the inside. If the helmet inner shell is formed from an expanded plastic material, and the helmet outer shell is formed using a conventional non-woven fabric without further processing, the lack of flexibility and elasticity of the fiber sheet causes complete transmission of an impact to the helmet inner shell, and the helmet inner shell is subjected to a large impact, thus posing a problem in taking a role as a safety helmet. In the case of using a conventional non-woven fabric in the helmet outer shell to improve this problem, the performance of impact absorbability would be improved if the apparent density is increased to 0.7 g/cc or higher and the thickness to 20 mm or larger. However, in this case, the overall size of the helmet shell will become large, and the weight will also increase, so that the purpose of introducing a fiber structural layer having a low apparent density cannot be achieved.

According to the present invention, in order to overcome such problems, the fiber sheet was subjected to a hot pressing treatment to thereby decrease the inherent flexibility of the fiber sheet, make the fiber sheet dense, and decrease flexibility and bendability to appropriate levels, so that the property of the fiber sheet of breaking or sagging under an external impact may be improved, and a satisfactory level of elasticity may be imparted to manifest excellent rigidity and toughness and to enhance impact absorbability. At this point, appropriate hot pressing treatment conditions are needed to prevent the apparent density of the fiber sheet as a whole from becoming very high. The details on the conditions will be described later.

The impact absorbability that is desired to be achieved in the helmet shell of the present invention is less than 300 G, and preferably 50 G or more and less than 250 G. Since the present invention has fortified impact absorbability, the thickness of the outer shell of the present invention is 6 mm or less, and preferably from 0.1 to 6 mm, under consideration of the overall weight of the helmet shell. According to another embodiment of the present invention, as a method of increasing the impact absorbability, when a fiber sheet is subjected to a hot pressing treatment, the fiber sheet is compressed in accordance with the heat treatment temperature and time, to thus form a compressed fiber sheet shell. The compressed fiber sheet shell may use a high melting point fiber that constitutes the skeleton of the fiber assembly, and also use a low melting point polymer or the like, which plays a role as an adhesive for binding the high melting point fiber strands. The melting point of the high melting point fiber is preferably 120 to 350° C., and the melting point of the low melting point fiber is preferably 50 to 200° C.

Preferably, in the present invention, the hot pressing treatment is conducted at a temperature lower than the melting point of the high melting point fiber constituting the skeleton and higher than or equal to the melting point of the low melting point polymer. Usually, this temperature is approximately in the range of 50° C. to 200° C., and therefore, the compressed fiber sheet in the lightweight helmet shell of the present invention is a product formed being subjected to a hot pressing treatment at a temperature in the range of approximately 50° C. to 200° C.

When the temperature of the hot pressing treatment is adequate, the compressed fiber sheet satisfies the requirement of impact absorbability, acquires an apparent density that is not very high, and exhibits appropriate rigidity and toughness properties. If the temperature of the hot pressing treatment is higher than the melting point of the high melting point fiber, the compressed fiber sheet may be excessively hardened. This may improve the impact absorbability, but the apparent density will be increased. If the temperature of the hot pressing treatment is lower than the melting point of the low melting point fiber, the compressed fiber sheet shell may not be sufficiently compressed, thus resulting in a low apparent density. Also, bendability may be satisfactory, but sufficient rigidity and toughness may not be imparted, and there may be a problem of deterioration in the impact absorbability.

The compressed fiber sheet outer shell can be produced by the steps of cutting a non-woven fabric, a woven fabric, a knitted fabric or the like; inserting the cut fiber sheet into a temperature-controlled forming mold; inserting a second mold to press the inserted fiber sheet; heating the forming mold to a temperature of 50° C. to 200° C. to perform molding for 10 seconds to 30 minutes; and releasing the forming mold to complete the compressed fiber sheet outer shell. The pressure used at the step of pressing may be, for example, 10 to 3,000 atm.

In the method for producing the compressed fiber sheet outer shell, production can also be carried out by previously heating the fiber sheet such as a non-woven fabric, a woven fabric or a knitted fabric, to a temperature of 50° C. to 200° C. at a site other than the forming mold, subsequently inserting the fiber sheet into a cold forming mold, and pressing and molding the fiber sheet.

In regard to the compressed fiber sheet outer shell according to the present invention, the compression ratio is preferably 1.2 times to 10 times. Such a compression ratio is closely related to the apparent density of the compressed fiber sheet, and the apparent density corresponding to the compression ratio is approximately 0.15 g/cc to 0.7 g/cc. If the apparent density is less than 0.15 g/cc, if the compression ratio is less than 1.2 times, and if the thickness is less than 0.1 mm, the apparent density is lowered, and breathability may be improved, but satisfactory impact absorbability (less than 300 G) may not be obtained. If the apparent density is greater than 0.7 g/cc, if the compression ratio is 10 times or higher, and if the thickness is greater than 6 mm, satisfactory impact absorbability may be sufficiently obtained, but the apparent density becomes so high that it becomes difficult to obtain a lightweight compressed fiber sheet outer shell intended by the present invention, and breathability is drastically deteriorated.

The compressed fiber sheet outer shell according to the present invention can be directly used in the case where breathability is requested. However, in the case where luxurious glossy paint-coating is requested, the compressed fiber sheet of the present invention has a problem of not exhibiting good coatability, since the external part of the sheet is formed from porous fiber strands. In order to address this problem, the present invention could improve the coatability at the outer side of the compressed fiber sheet outer shell by attaching a film formed of a thermoplastic resin or a thermosetting resin having a thickness of 0.01 mm to 0.8 mm, to the outer side of the compressed fiber sheet outer shell, and integrating the film with the compressed fiber sheet outer shell, or by melting a thermosetting resin or a thermoplastic resin at the outer side of the compressed fiber sheet outer shell to provide a coating film having a thickness of 0.01 mm to 0.8 mm. Alternatively, the coatability at the outer side of the compressed fiber sheet outer shell could be improved by pretreating the compressed fiber sheet outer shell with a primer or the like, and then coating a paint to form a coating film having a thickness of 0.01 mm to 0.8 mm. This formation of a film or a coating film makes it possible to realize the luxurious decoration shown by conventional helmet outer shells, by improving the coatability at the outer side of the compressed fiber sheet outer shell.

The lightweight helmet shell according to the present invention has a reduced thickness and excellent breathability, is lightweight, and has impact absorbability, and therefore, the range of applications can be extensive. For example, in the case of applying the lightweight helmet shell in riding hoods, since the outer surface of the outer shell is finished with cloth or the like, when breathing vents are provided in the inner shell formed of expanded polystyrene or the like, natural breathability is exhibited to a certain extent during horse riding. Thus, evaporation resulting from sweat generated from the head can be easily discharged to the outside, and the hood wearer can feel pleasantness.

Description of the Preferred Embodiments

EXAMPLES

Example 1

A helmet inner shell was produced using expanded polystyrene, to have a thickness of 15 mm and an apparent density of 0.04 g/cc. A non-woven fabric having an apparent density of 0.07 g/cc and a thickness of 7 mm was subjected to a hot pressing treatment at a compression ratio of 1/3.5, and then the treated non-woven fabric was cut out to form the shape of the head. The non-woven fabric was inserted into a forming mold at a temperature of 100° C., and an inner mold at a temperature of 100° C. was inserted therein, to press the fiber sheet at a pressure of 100 atm for 20 seconds. Thus, a compressed fiber sheet shell having the shape of the head and having an apparent density of 0.25 g/cc and a thickness of 2.0 mm, which would be used as a helmet outer shell, was produced. Using the same method, a non-woven fabric having an apparent density of 0.166 g/cc and a thickness of 6 mm was subjected to a hot pressing treatment at a compression ratio of 1/1.5, and thereby a compressed fiber sheet having an apparent density of 0.25 g/cc and a thickness of 4.0 mm was additionally produced. The head-shaped compressed fiber sheet shell was cut into a semispherical shape, and the area of the outer surface was calculated. The area was found to be 1,096 $cm^2$.

The compressed fiber sheet shell produced in Example 1 above was evaluated by the measurement methods described below, and the following results were obtained.

In order to measure the impact absorbability of a helmet having a helmet outer shell formed from the compressed fiber sheet shell according to the present invention, and a helmet inner shell formed of expanded polystyrene, an impact absorption test was performed using a SNELL M2000 (Snell Memorial Foundation). The helmet produced as described above was put on a head-shaped model weighing 5 kg, and the helmet was dropped on a semispherical impact anvil made of stainless steel so that a predetermined amount of impact energy (J) would be exerted on the helmet. The impact acceleration (G) at the time of dropping was measured.

Specifically, on the first round, the helmet was dropped from a height of 3.12 m, and thus an amount of impact energy equivalent to 150 J was exerted on the helmet. On the second round, the helmet was dropped from a height of 2.22 m, and thus an amount of impact energy equivalent to 110 J was exerted on the helmet. If the impact absorbability values obtained from the two rounds were both less than 300 G, the helmet was considered acceptable. The tested sites were the right and left lateral sides of the helmet.

The apparent density was measured by cutting and collecting a specimen having a length of 25 mm and a width of 25 mm from the helmet outer shell.

The air permeability was measured by the method for measuring the air permeability in cloth according to KS K0570.

The results are presented in the following Table 1 and Table 2.

Example 2

A non-woven fabric having an apparent density of 0.11 g/cc and a thickness of 8.2 mm was subjected to a hot pressing treatment at a compression ratio of 1/4.1, and then a compressed fiber sheet shell having an apparent density of 0.45 g/cc and a thickness of 2.0 mm was produced, in the same manner as in Example 1. Also, a non-woven fabric having an apparent density of 0.23 g/cc and a thickness of 7.8 mm was subjected to a hot pressing treatment at a compression ratio of 1/2, and then a compressed fiber sheet shell having a thickness of 4.0 mm was produced. The impact absorbability and air permeability of the two compressed fiber sheet shells were measured by the same methods as those used in Example 1. The results are presented in Table 1 and Table 2.

Example 3

A non-woven fabric having an apparent density of 0.07 g/cc and a thickness of 18.5 mm was subjected to a hot pressing treatment at a compression ratio of 1/9.3, and then a compressed fiber sheet shell having an apparent density of 0.65 g/cc and a thickness of 2.0 mm was produced, in the same manner as in Example 1. Also, a non-woven fabric having an apparent density of 0.15 g/cc and a thickness of 17 mm was subjected to a hot pressing treatment at a compression ratio of 1/4.3, and then a compressed fiber sheet shell having a thickness of 4.0 mm was produced. The impact absorbability and air permeability of the two compressed fiber sheet shells were measured by the same methods as those used in Example 1. The results are presented in Table 1 and Table 2.

Example 4

A helmet inner shell was produced in the same manner as in Example 1, using expanded polystyrene to have a thickness of 35 mm and an apparent density of 0.04 g/cc. A non-woven fabric having an apparent density of 0.07 g/cc and a thickness of 2.0 mm was subjected to a hot pressing treatment at a compression ratio of 1/9.7, and then a compressed fiber sheet shell having an apparent density of 0.68 g/cc and a thickness of 0.2 mm was produced. The impact absorbability and air permeability of the two compressed fiber sheet shells were measured by the same methods as those used in Example 1. The results are presented in Table 1 and Table 2.

Comparative Example 1

A VR-2R (KBC America, Inc., USA) is a currently marketed product, and is a sufficiently satisfactory product having a conventional helmet outer shell made of a glass fiber-reinforced plastic that has an impact absorbability of 250 G or less. The helmet outer shell has an apparent density of 1.7 g/cc, and the helmet outer shell material itself has no breathability at all. The helmet outer shell was cut into a semispherical shape, and the outer surface area was measured by the same method as that used in Example 1. As a result, the area was found to be 1,096 $cm^2$, and the weight of the helmet outer shell was found to 373 g.

Comparative Example 2

A riding hood produced from a common plastic, CP-8343 (Soyo Enterprise, Ltd., Republic of Korea), has an impact absorbability of less than 300 G, and the outer shell is produced from a common plastic. The outer shell material itself has no breathability at all, and has an apparent density of 0.91 g/cc. The outer shell surface area was 1,096 cm2, which was the same as the outer shell area of Example 1, and the weight of the helmet outer shell was found to 199 g.

TABLE 1

Results of measurement of impact absorbability (G)

| | Example 1 | | Example 2 | | Example 3 | | Example 4 | |
|---|---|---|---|---|---|---|---|---|
| Thickness (mm) | Round 1 | Round 2 | Round 1 | Round 2 | Round 1 | Round 2 | Round 1 | Round 2 |
| 0.2 (left/right) | — | — | — | — | — | — | 193/196 | 244/249 |
| 2.0 (left/right) | 174/171 | 227/221 | 156/152 | 209/207 | 134/133 | 185/187 | — | — |
| 4.0 (left/right) | 157/156 | 195/192 | 141/139 | 177/172 | 119/116 | 162/159 | — | — |

TABLE 2

| | Example 1 | | Example 2 | | Example 3 | | Example 4 | Comparative Example 1 | Comparative Example 2 |
|---|---|---|---|---|---|---|---|---|---|
| Thickness (mm) | 2.0 | 4.0 | 2.0 | 4.0 | 2.0 | 4.0 | 0.2 | 2.0 | 2.0 |
| Apparent density (g/cc) | 0.25 | 0.25 | 0.45 | 0.45 | 0.65 | 0.65 | 0.68 | 1.70 | 0.91 |
| Helmet outer shell weight (g) | 55 | 110 | 99 | 197 | 142 | 285 | 15 | 373 | 199 |
| Air permeability ($cm^3/min/cm^2$) | 257.4 | 1,380 | 121.0 | 126.1 | 43.8 | 54.1 | 29.6 | 0 | 0 |

The test results for the Examples show that an impact absorbability value of less than 300 G was obtained in all of the two rounds for each Example.

The compressed fiber sheet shells produced in the Examples 1, 2 and 3 had smaller apparent densities, and the apparent densities were about 1/7 of the apparent density of the product of Comparative Example 1, and were about ¼ of the apparent density of the product of Comparative Example 2. Thus, the compressed fiber sheet shells are lightweight, and the feeling of weight of the helmets perceived by the wearer can be largely mitigated. Furthermore, since the helmet shells can be produced by simple processes using inexpensive materials as shown in Examples 1, 2 and 3, it proves that the helmet shells of the present invention are economically advantageous.

As described above, although the present invention has been explained by way of limited Examples, the present invention is not intended to be limited thereby, and any person having ordinary skill in the art to which the present invention pertains will be definitely able to carry out various corrections and modifications within a scope equivalent to the scope of the technical idea of the present invention and the claims that will be described below.

What is claimed is:

1. A lightweight helmet shell comprising an inner shell and an outer shell, wherein the outer shell includes a compressed fiber sheet having an apparent density of 0.15 to 0.7 g/cc and an impact absorbability of 50 G or more and less than 300 G, wherein the inner shell includes a porous expanded plastic layer having an apparent density of 0.005 to 0.2 g/cc.

2. The lightweight helmet shell according to claim 1, wherein the compressed fiber sheet is a product obtained by subjecting a fiber sheet formed from a material containing any one selected from the group consisting of polyethylene, polypropylene, polyester, viscose rayon, nylon, cotton, hemp, wool and combinations thereof, to a hot pressing treatment at a compression ratio of 1.2 times to 10 times.

3. The lightweight helmet shell according to claim 2, wherein the fiber sheet is any one selected from the group consisting of a non-woven fabric, a woven fabric, and a knitted fabric.

4. The lightweight helmet shell according to claim 2, wherein the hot pressing treatment is conducted at a temperature of 50° C. to 200° C. and at a pressure of 10 to 3,000 atm, for 10 seconds to 30 minutes.

5. The lightweight helmet shell according to claim 1, wherein the compressed fiber sheet includes a high melting point fiber which forms a fiber structural layer of the compressed fiber sheet and has a melting point of 120 to 350° C., and a low melting point fiber which binds the high melting point fiber strands and has a melting point of 50 to £ 200° C.

6. The lightweight helmet shell according to claim 1, wherein the compressed fiber sheet has an air permeability of 10 to 2,000 $cm^3/min/cm^2$.

7. The lightweight helmet shell according to claim 1, wherein the outer shell has a thickness of 0.1 mm to 6 mm.

8. The lightweight helmet shell according to claim 1, further comprising a thermosetting resin or thermoplastic resin film layer having a thickness of 0.01 mm to 0.8 mm, formed on the outer side of the outer shell.

9. The lightweight helmet shell according to claim 1, further comprising a coating film layer having a thickness of 0.01 mm to 0.8 mm, formed on the outer side of the outer shell by melting a thermosetting resin or thermoplastic resin.

10. The lightweight helmet shell according to claim 1, further comprising a coating film layer formed by pretreating the outer side of the outer shell with a primer, and then coating a paint to a thickness of 0.01 mm to 0.8 mm.

11. A method for manufacturing a lightweight helmet shell according to claim 1, the method comprising:

producing a fiber sheet;

pressing the fiber sheet in a forming mold at a pressure of 10 to 3,000 atm; and heating the fiber sheet at 50° C. to 200° C. for 10 seconds to 30 minutes to produce a compressed fiber sheet.

12. The method for manufacturing a lightweight helmet shell according to claim 11, wherein the compressed fiber sheet is a product obtained by subjecting the fiber sheet to a hot pressing treatment at a compression ratio of 1.2 times to 10 times.

13. The method for manufacturing a lightweight helmet shell according to claim 11, wherein the fiber sheet is formed from a material containing any one selected from the group consisting of polyethylene, polypropylene, polyester, viscose rayon, nylon, cotton, hemp, wool and combinations thereof.

14. The method for manufacturing a lightweight helmet shell according to claim 11, wherein the fiber sheet is any one selected from the group consisting of a non-woven fabric, a woven fabric, and a knitted fabric.

15. The method for manufacturing a lightweight helmet shell according to claim 11, wherein the fiber sheet includes:

a high melting point fiber which forms a fiber structural layer of the compressed fiber sheet and has a melting point of 120 to 350° C., and a low melting point fiber which binds the high melting point fiber strands and has a melting point of 50 to 200° C.

* * * * *